US011519136B2

(12) United States Patent
Robidoux

(10) Patent No.: US 11,519,136 B2
(45) Date of Patent: Dec. 6, 2022

(54) PAVING STONE EDGE JOINT FILL BLOCKER

(71) Applicant: Frédéric Robidoux, Beloeil (CA)

(72) Inventor: Frédéric Robidoux, Beloeil (CA)

( * ) Notice: Subject to any disclaimer, the term of this patent is extended or adjusted under 35 U.S.C. 154(b) by 39 days.

(21) Appl. No.: 17/119,716

(22) Filed: Dec. 11, 2020

(65) Prior Publication Data

US 2021/0180265 A1 Jun. 17, 2021

Related U.S. Application Data

(60) Provisional application No. 62/946,637, filed on Dec. 11, 2019.

(51) Int. Cl.
*E01C 5/00* (2006.01)

(52) U.S. Cl.
CPC ..... *E01C 5/006* (2013.01)

(58) Field of Classification Search
CPC . E01C 5/006; E01C 11/02; E01C 5/00; E01C 5/03
See application file for complete search history.

(56) References Cited

U.S. PATENT DOCUMENTS 3,263,388 A * 8/1966 Bogert ..... E04B 9/20 248/342
3,696,575 A * 10/1972 Armstrong ..... E04B 1/6804 52/395
4,533,278 A * 8/1985 Corsover ..... E01C 11/10 404/69
5,009,387 A * 4/1991 Scott ..... E04G 9/10 249/189
8,826,481 B1 * 9/2014 Haydu ..... E01C 11/02 404/69
2006/0283117 A1 * 12/2006 Williams ..... E04F 19/065 52/393
2010/0229783 A1 * 9/2010 Szekely ..... E01C 5/22 116/202
2012/0121328 A1 * 5/2012 White ..... E01C 5/006 404/99
2014/0169877 A1 * 6/2014 Reising ..... E01C 13/045 404/27

(Continued)

FOREIGN PATENT DOCUMENTS

GB 2228953 A * 9/1990 ..... E01C 5/003
GB 2303649 A * 2/1997 ..... E01C 5/006
GB 2489030 A * 9/2012 ..... E01C 5/006

(Continued)

*Primary Examiner* — Abigail A Risic
(74) *Attorney, Agent, or Firm* — Benoit & Cote Inc.; Mathieu Audet

(57) ABSTRACT

A fill blocker to block a gap between two paving stones each having a side face facing each other and an outer face wherein the fill blocker prevents filling material inserted between the paving blocks to escape through the gap. The fill blocker comprising a body comprising an interior face having two abutting portions and a fill-blocking portion therebetween; and a holding component extending from the interior face adapted to be wedged between the side faces. The fill blocker is adapted to have the holding component inserted in the gap between the side faces and be wedged therein with the abutting portions abutting the outer faces of the paving stones and thereby blocking the gap.

20 Claims, 6 Drawing Sheets

(56) References Cited

U.S. PATENT DOCUMENTS

| | | | | |
|---|---|---|---|---|
| 2014/0270944 | A1* | 9/2014 | White | E01C 23/01<br>404/27 |
| 2016/0222601 | A1* | 8/2016 | Alfieri, III | E01C 11/221 |

FOREIGN PATENT DOCUMENTS

| | | | | |
|---|---|---|---|---|
| KR | 200385053 | Y1 * | 5/2005 | |
| KR | 20200028719 | A * | 3/2020 | |
| WO | WO-0159231 | A1 * | 8/2001 | E01C 5/006 |

* cited by examiner

PAVING STONE EDGE JOINT FILL BLOCKER

CROSS-REFERENCE TO RELATED APPLICATION

This application claims priority from U.S. provisional patent application 62/946,637 filed Dec. 11, 2019, the specification of which is hereby incorporated herein by reference in its entirety.

BACKGROUND

(a) Field

The subject matter disclosed generally relates to landscaping, and more particularly to installation of paving stones. More particularly, the subject matter disclosed relates to devices used in relation with the filling of the gaps between the paving stones during their installation.

(b) Related Prior Art

In the field of paving stone installation, when preparing and installing paving stones in an exterior area to create a relaxing outdoor space, it is a common practice that gaps are present between the paving stones. Therefore, it is common practice to fill these spaces with natural or compound sand (i.e., filling material). However, most of the time the final product features partially filled spaces, and most of these incompletely filled spaces are located at the periphery or edges of the stoned area. The presence of these incompletely filled spaces are problematic for the maintenance of the stoned area and for its unaesthetic appearance. Furthermore, weeds tend to grow in the gaps when not well filled, and thus they tend to grow at the edges of the stoned area.

The less the gaps between the paving stone are properly filled, the more they tend to get dirty easily. Hence the stoned area rapidly loses its great look.

There is therefore a need for a solution to have the gaps between the paving stones to be completely filled with filling material and to prevent the filling material from washing away from the stoned area; i.e., to remain blocked in the gaps.

SUMMARY

According to an embodiment, there is provided a fill blocker to be wedged against outer faces and between side faces of paving stones which are spaced apart thereby defining a gap between side faces, the fill blocker comprising: a body comprising an interior face; and a holding component, comprising: a stem extending from the interior face; and a plurality of lips extending sideward from the stem, wherein the lips are sloped toward the interior face relative to the stem such that the lips wedges against the side faces of the paving stones when inserted in the gap with the interior face abutting against the outer faces thereby ensuring that the fill blocker remains in place while filling the gap with filling material.

According to an aspect, the body comprises abutting portions for abutting the paving stones outside the gap.

According to an aspect, the lips are sloped toward the interior face as they extend sideway from the stem.

According to an aspect, the interior face comprises a substantially flat portion thereby aligning the outer faces of neighboring paving stones while closing the gap therebetween.

According to an aspect, the body further comprises a top portion and a bottom portion and a trench area between the top portion and the bottom portion.

According to an aspect, the trench area is one of breakable and cuttable, thereby once the trench area is broken or cut, the bottom portion is separated from the bottom portion.

According to an aspect, the stem comprises a first stem element and a second stem element having an acute angle greater than zero (0) degree therebetween.

According to an embodiment, there is provide a fill blocker to block a gap between two paving stones each having an outer face and a side face, wherein the side faces of respective paving stones face each other, the fill blocker comprising: a body comprising an interior face having two abutting portions and a fill-blocking portion therebetween; and a holding component extending from the interior face adapted to be wedged between the side faces, wherein when the holding component is inserted in a gap between the side faces and wedged therein the abutting portions abut the outer faces of the paving stones.

According to an aspect, the holding component comprises deformable components adapted to abut the side faces of the paving stones.

According to an aspect, the holding component comprises a stem extending from the interior face and wherein the deformable components extend from the stem.

According to an aspect, the deformable components comprise a plurality of lips extending from the stem.

According to an aspect, the lips are sloped toward the interior face as they extend sideway from the stem.

According to an aspect, the abutting portion are flat.

According to an aspect, the body further comprises a top portion and a bottom portion and a trench area between the top portion and the bottom portion.

According to an aspect, the bottom portion is flexible relative to the top portion.

According to an aspect, the trench area is one of breakable and cuttable, thereby once the trench area is broken or cut, the bottom portion is separated from the bottom portion.

According to an aspect, the holding component comprises a pair of stems having an acute angle greater than zero (0) degree therebetween.

According to an aspect, the fill blocker is a unibody.

According to an aspect, the fill-blocking portion defines an unbroken surface.

According to an embodiment, there is provided a fill blocker to be wedged between faces of paving stones which are spaced apart thereby defining a gap therebetween, the fill blocker comprising: a body comprising an interior face; and a holding component, comprising a stem extending substantially perpendicularly from the interior face; wherein the stem wedges against the faces of the paving stones when inserted in the gap thereby ensuring that the fill blocker remains in place while filling the gap with filling material.

Features and advantages of the subject matter hereof will become more apparent in light of the following detailed description of selected embodiments, as illustrated in the accompanying figures. As will be realized, the subject matter disclosed and claimed is capable of modifications in various respects, all without departing from the scope of the claims. Accordingly, the drawings and the description are to be regarded as illustrative in nature and not as restrictive and the full scope of the subject matter is set forth in the claims.

BRIEF DESCRIPTION OF THE DRAWINGS

Further features and advantages of the present disclosure will become apparent from the following detailed description, taken in combination with the appended drawings, in which.

It will be noted that throughout the appended drawings, like features are identified by like reference numerals.

DETAILED DESCRIPTION

The realizations will now be described more fully hereinafter with reference to the accompanying figures, in which realizations are illustrated. The foregoing may, however, be embodied in many different forms and should not be construed as limited to the illustrated realizations set forth herein.

With respect to the present description, references to items in the singular should be understood to include items in the plural, and vice versa, unless explicitly stated otherwise or clear from the text. Grammatical conjunctions are intended to express any and all disjunctive and conjunctive combinations of conjoined clauses, sentences, words, and the like, unless otherwise stated or clear from the context. Thus, the term "or" should generally be understood to mean "and/or" and so forth.

Recitation of ranges of values and of values herein or on the drawings are not intended to be limiting, referring instead individually to any and all values falling within the range, unless otherwise indicated herein, and each separate value within such a range is incorporated into the specification as if it were individually recited herein. The words "about," "approximately," or the like, when accompanying a numerical value, are to be construed as indicating a deviation as would be appreciated by one of ordinary skill in the art to operate satisfactorily for an intended purpose. Ranges of values and/or numeric values are provided herein as examples only, and do not constitute a limitation on the scope of the described realizations. The use of any and all examples, or exemplary language ("e.g.," "such as," or the like) provided herein, is intended merely to better illuminate the exemplary realizations and does not pose a limitation on the scope of the realizations. No language in the specification should be construed as indicating any unclaimed element as essential to the practice of the realizations.

In the following description, it is understood that terms such as "first", "second", "top", "bottom", "above", "below", and the like, are words of convenience and are not to be construed as limiting terms.

Figure 3:
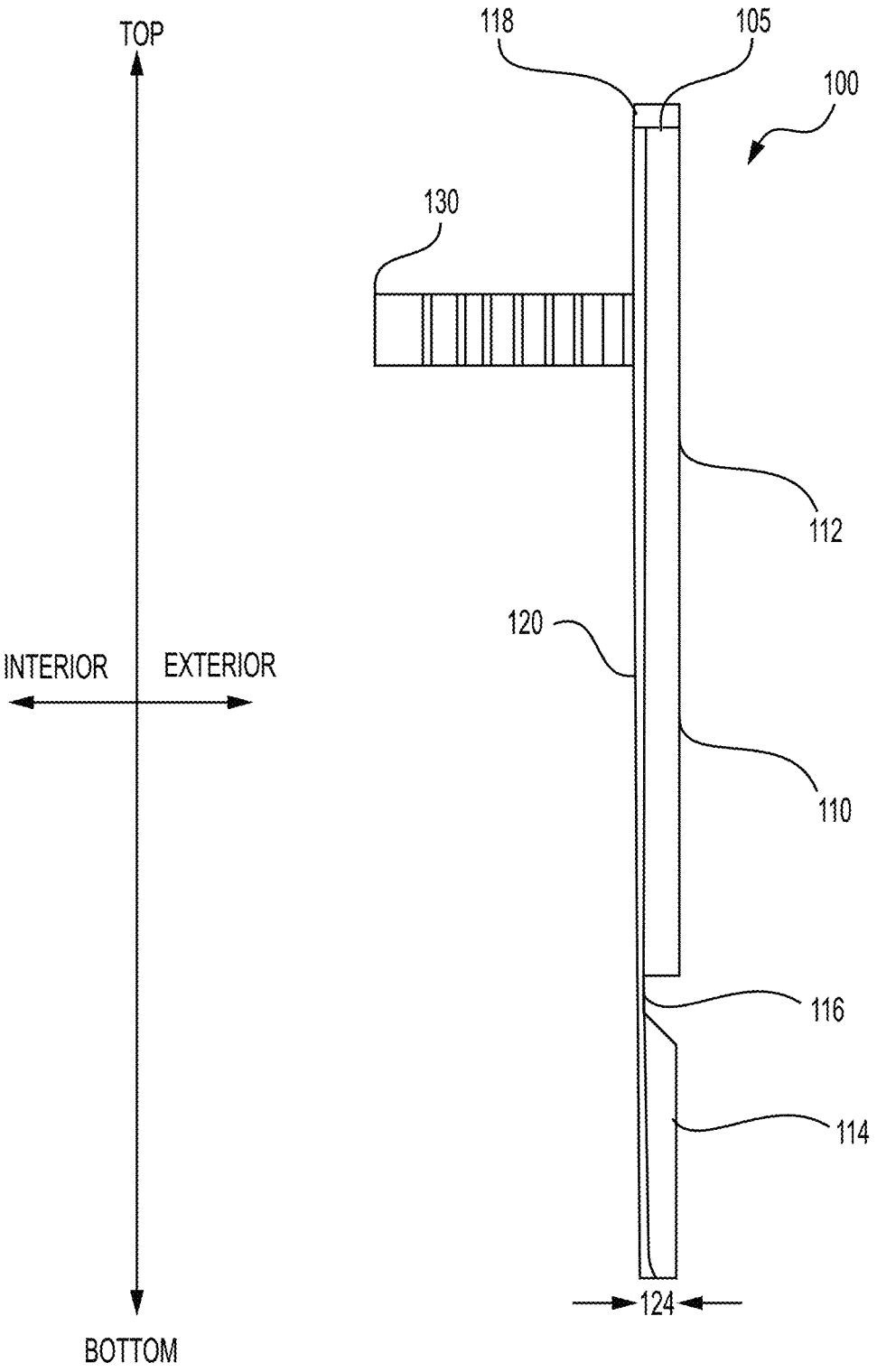
FIG. 3 is a side view of the fill blocker depicted on FIGS. 1 and 2.
Figure 4:
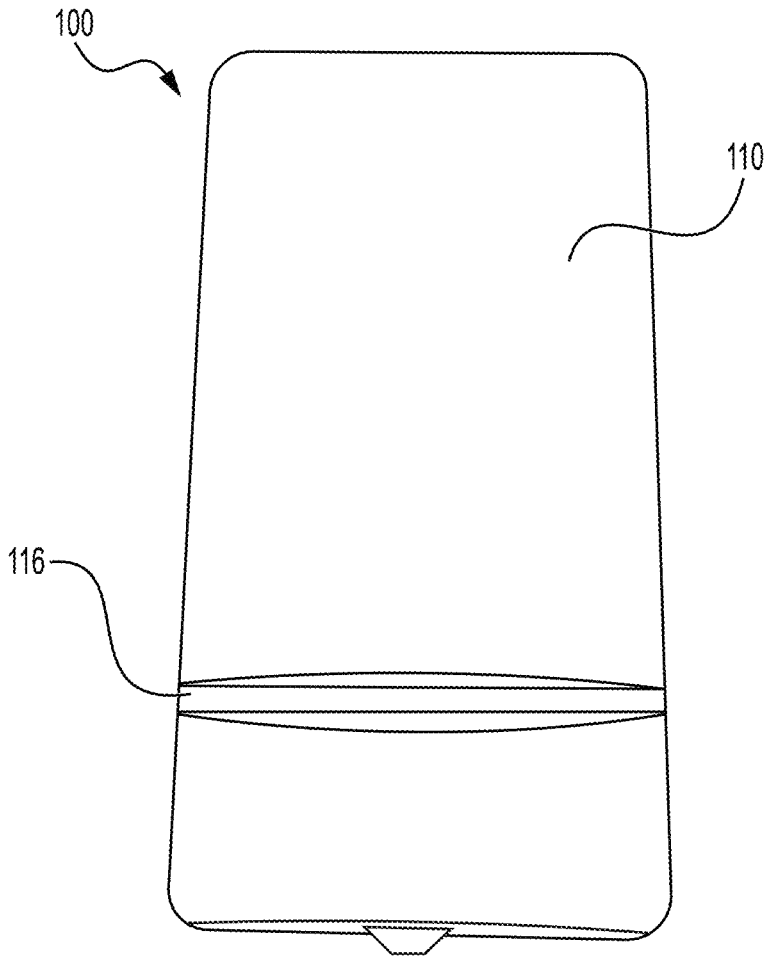
FIG. 4 is an elevated view of the fill blocker of FIGS. 1 to 3 held by the bottom with the exterior face shown.
Figure 5:
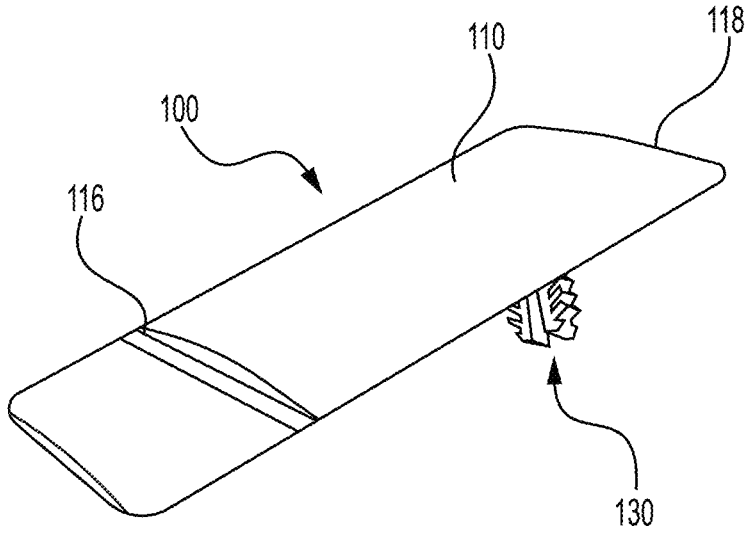
FIG. 5 is a view of the fill blocker of FIGS. 1 to 4 held by the bottom with the exterior face shown.

The terms "top", "up", "upper", "bottom", "lower", "down", "vertical", "horizontal", "interior" and "exterior" and the like are intended to be construed in their normal meaning in relation with normal installation of the product, with indication of normal orientation of the components being provided on FIG. 3.

According to an aspect, there is disclosed a paving stone edge joint fill blocker 100, hereinafter fill blocker 100, for obtaining a great-looking surface of a stoned area that looks leveled and uniform up to the edge of the stoned area. Therefore, the quality and durability of the stoned area is improved. Furthermore, the installation of the stoned area, and more particularly the insertion of filling material in the gaps is made easier by the use of the fill blocker 100. This is particularly true near the edges of the stoned area. Therefore, the maintenance of the stoned area is also improved by keeping the filling material in place in the gaps, and more particularly close to the edges of the stoned area.

The expression "filling material" is meant to include, but is not limited to sand, polymeric sand, grout, cement, etc.

It will be noted that throughout the appended drawings, like features are identified by like reference numerals.

Figure 1:
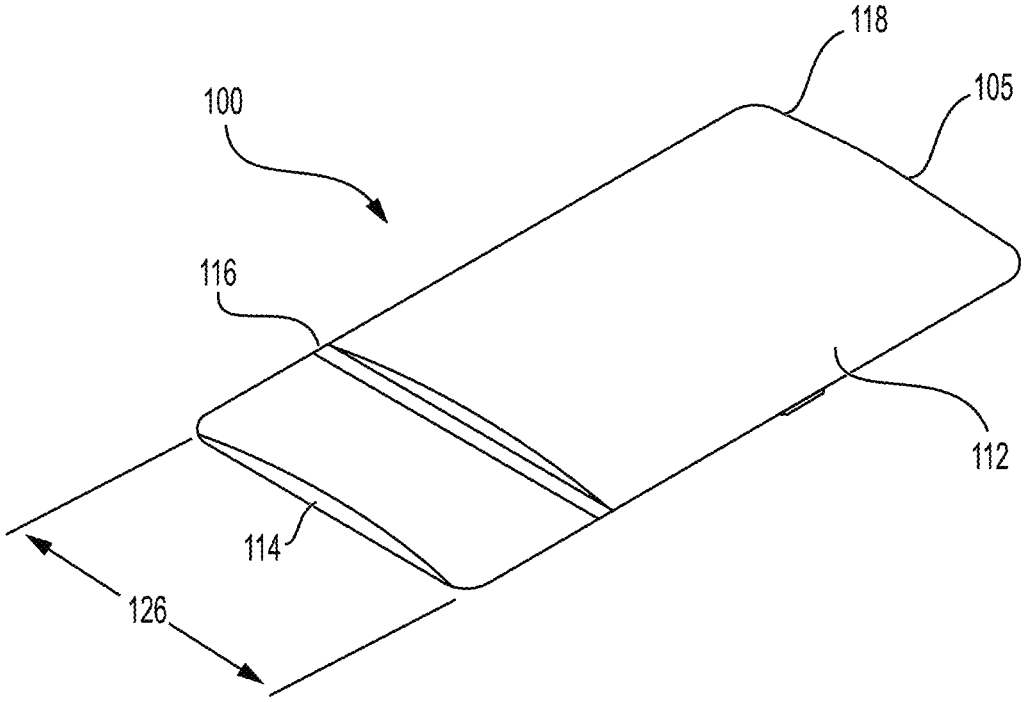
FIG. 1 is a perspective view of a fill blocker in accordance with an embodiment.

Referring now to the drawings, and more particularly to FIG. 1, the paving stone edge fill blocker 100 comprises a body 105 comprising an exterior face 110. According to an embodiment, the exterior face 110 has a convex shape transversal to the longitudinal orientation (aka top-bottom axis identified on FIG. 3) providing an additional strength to resist deformation when undergoing pressure from the interior side.

According to an embodiment, the body 105 of the fill blocker 100 is divided in two portions: a top portion 112 with its height corresponding to the normal thickness of the paving stones 90 (see FIG. 8) and a bottom portion 114 extending down from the top portion 112. The bottom portion 114 is distinct from the top portion 112 in that it is separated from the top portion 112 by a trench area 116 introducing a weakness in the material and allowing the bottom portion 114 to be either folded or easily detached (broken off or cut) from the top portion 112.

Figure 2:
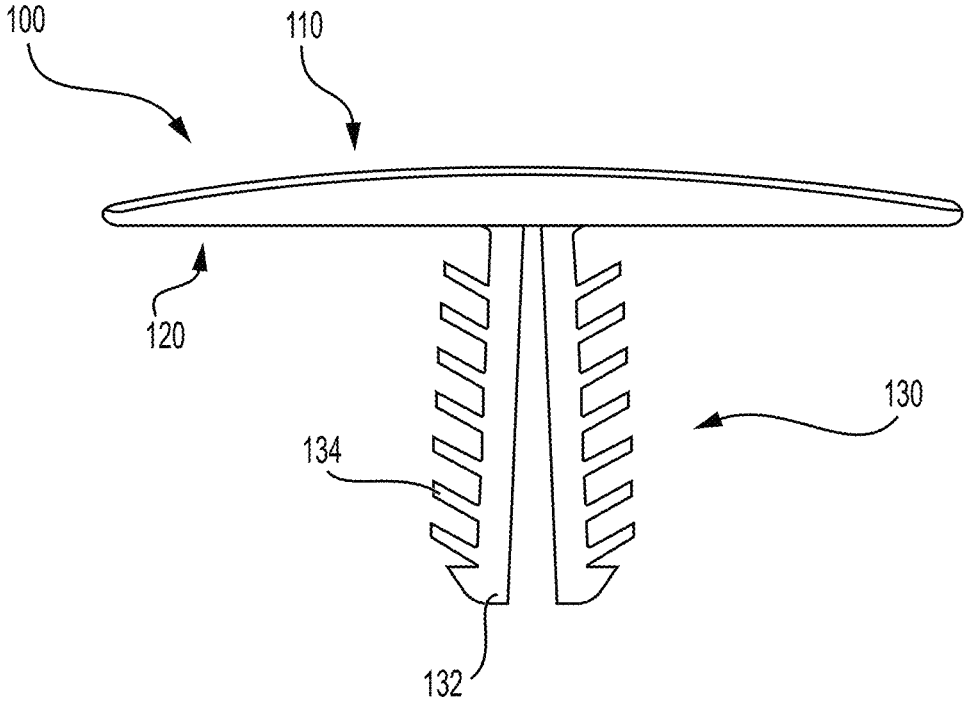
FIG. 2 is a top view of the fill blocker depicted on FIG. 1.

Referring to FIG. 2, the fill blocker 100 seen from the top depicts the body 105 comprising an exterior face 110 and an interior face 120 opposed to the exterior face 110. Extending from the interior face 120 is a holding component 130 comprising two stems 132, aka stem elements, extending therefrom. According to an embodiment, the stems 132 extend from the interior face 120 at an angle which is greater than 80 degrees (i.e., substantially perpendicularly). Each one of the stems 132 comprises lips 134 extending sideways, and outwardly from the stem 132 and sloped with an angular component toward the interior face 120. One of the stems 132 is sized to fit smaller openings (i.e., openings from ½ in. to ¼ in.)

According to a realization, the holding component 130 comprises a plurality of deformable lips 134 (aka deformable components) such that the additive effect of the plurality of lips 134 holds the fill blocker 100 in position once inserted between two paving stones 90. According to the depicted realization, neighboring lips 134 have a longitudinal gap therebetween that is substantially uniform over the entire thickness (in the longitudinal orientation) of the lips 134.

Stems 132 are designed with an acute angle greater than zero (0) degrees therebetween to thereby extend slightly toward the side of the fill blocker 100 to be adaptable for a variety of gap widths taking place between two paving stones 90. Depending on the width of the gap between two paving stones 90, the stems 132 may remain in position or may bend inwardly pushed toward a virtual central plane located between the stems 132. The stems 132 may thus be pushed by the side of the paving stones 90 to fit the available width.

Referring now to FIG. 3, the side view of the fill blocker 100 depicts the trench area 116, aka scorned, thin or weak portion, between the top portion 112 and the bottom portion 114. FIG. 3 suggests the easy bending of the fill blocker 100 about the trench area. The bending mandatorily takes place at the trench area 116 when trying to bend the fill blocker 100.

FIG. 3 also shows that, according to a realization, a pair (aka a single series) of opposed holding components 130 extend from the interior face 120 above the trench area 116.

According to other realizations (not shown), more than one pair of holding components 130 extend from the interior face 120, the pair of holding components 130 being located one above the other above the trench area 116. Alternatively, the height of the stem(s) 132 and lips 134 may be adapted for paving stones 90 of different thicknesses and textures.

According to other realizations (not shown), the fill blocker 100 comprises a single holding component 130 comprising a single stem 132 with lips 134 extending outwardly on both sides of the stem 132.

FIGS. 4 to 7 depicts the fill blocker 100 according to different angles, showing the trench area 116 and the holding components 130 according to the depicted angles.

Figure 6:
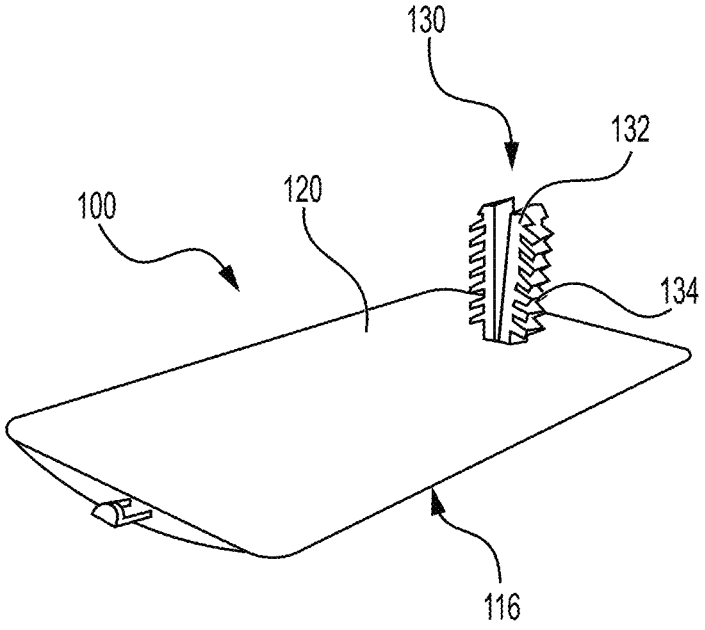
FIG. 6 is a perspective view of the fill blocker of FIGS. 1 to 5 held by the bottom with the interior face and the holding components shown.

FIG. 6 shows particularly well the interior face 120 (which comprises a substantially flat portion) with the sides of the interior face 120 being adapted to each have an edge band (not identified since depending on the width of the gap between two paving stones 90 when installed to be defined) abutting the side of the paving stones 90 once installed to close the gap between the paving stones 90. The slightly convex shape of the body 105 provides structure for the edge bands to provide the desired resistance while minimizing the overall thickness of the body 105 and thus of the fill blocker 100.

According to realizations as depicted and understood from FIGS. 1 to 3, characteristics of the paving stones 90 and of the filling material, the number of holding components 130, the number of stems 132 per holding component 130, the number of lips 134 per stems 132 and the texture and angle of the lips 134 are adapted to provide the required wedge over the sides of the paving stones 90 for the fill blocker 100 to maintain its holding component(s) 130 in place after it is sled between the paving stones 90.

The fill blocker 100 is, according to a preferred realization, a unibody.

In preferred realizations, the number of holding components 130 is one (1), but may include more such as three (3). The number of stems 132 per holding component 130 is one (1) or two (2). The number of lips per holding component 130 are between two (2) and twenty (20). The gaps between the stems 132 and/or between the lips 134 are in the longitudinal direction (parallel to the height).

In a preferred realization, the trench area 116 has a height at least equal to the maximum thickness 124 of the body 105 to allow folding both forward and backward the bottom portion 114.

Figure 7:
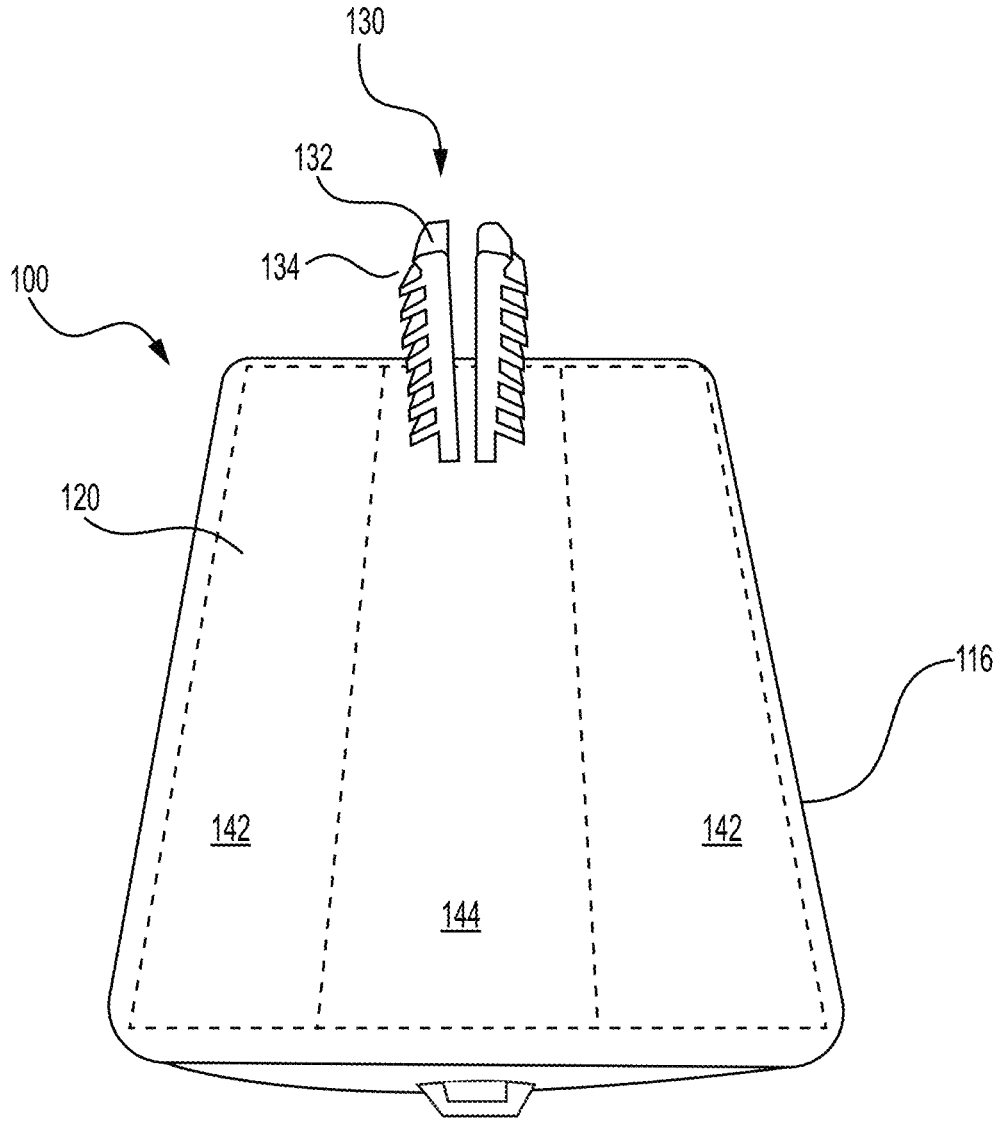
FIG. 7 is a perspective view like FIG. 6 from an angle closer to the longitudinal axis of the fill blocker.

The interior face 120 comprises a paving-stone abutting portion 142 (see FIG. 7) and fill-blocking portion 144 (see FIG. 7). According to realizations, the paving-stone abutting portion 142 (or two separate abutting portions 142 according to an embodiment) and the fill-blocking portion 144 are level with each other and provide a substantially flat interior face 120. The flat interior face 120 is substantially flat in to perform its function of aligning the two outer faces 96 of neighboring paving stones 90 while closing the gap therebetween as will be further explained herein. Hence, it can have imperfections which are acceptable to those skilled in the art and for the purpose of installing paving stones 90.

According to alternative realizations, the paving-stone abutting portion 142 and the fill-blocking portion 144 are unlevel; the fill-blocking portion extending inwardly relative to the paving-stone abutting portion 142.

According to realizations, the interior face of the fill-blocking portion 144 is one of: flat, sloped upward, sloped downward and arched.

According to a preferred realization, the bottom portion 114 defines an unbroken surface, meaning a surface free of holes and other apertures through which the filling material may escape from the space between the sides faces 94 of the paving stones 90.

According to realizations, the fill blocker 100 has a height of between 2½ in. and 3½ in. (preferably, 3 in.). The top portion 112 has a height of between 1 15/16 in. and 2 7/16 in. (preferably 2 3/16 in.). The bottom portion 114 has a height of between 9/16 in. and 1 1/16 in. (preferably 13/16 in.). The fill blocker 100 has a maximum width 126 of between 1 in. and 2½ in. The body 105 of the fill blocker 100 has a thickness (measured from the paving-stone abutting portion 142 to the exterior face 110 above the trench area 116) at the center of between 1⅛ in. and 1⅝ in. (preferably 1⅜ in.). The holding component(s) 130 extend(s) between 9/16 in. and 13/16 in. (preferably 11/16 in.) from the interior face 120. The holding component(s) 130 has(ve) each a height of between ¼ in. and ½ in.

According to a preferred realization, the exterior face 110 has a substantially uniform convex shape transversal to the longitudinal orientation.

According to another realization (not depicted), the fill blocker 100 features side wings extending sideward from the fill-blocking portion 144 and flexible outwardly, wherein the side wings are connected to the body through trench areas that allows the fill blocker 100 to marry on a wider surface non-straight outer edges of stones areas 95 about the gap between two paving stones 90.

Figure 8:
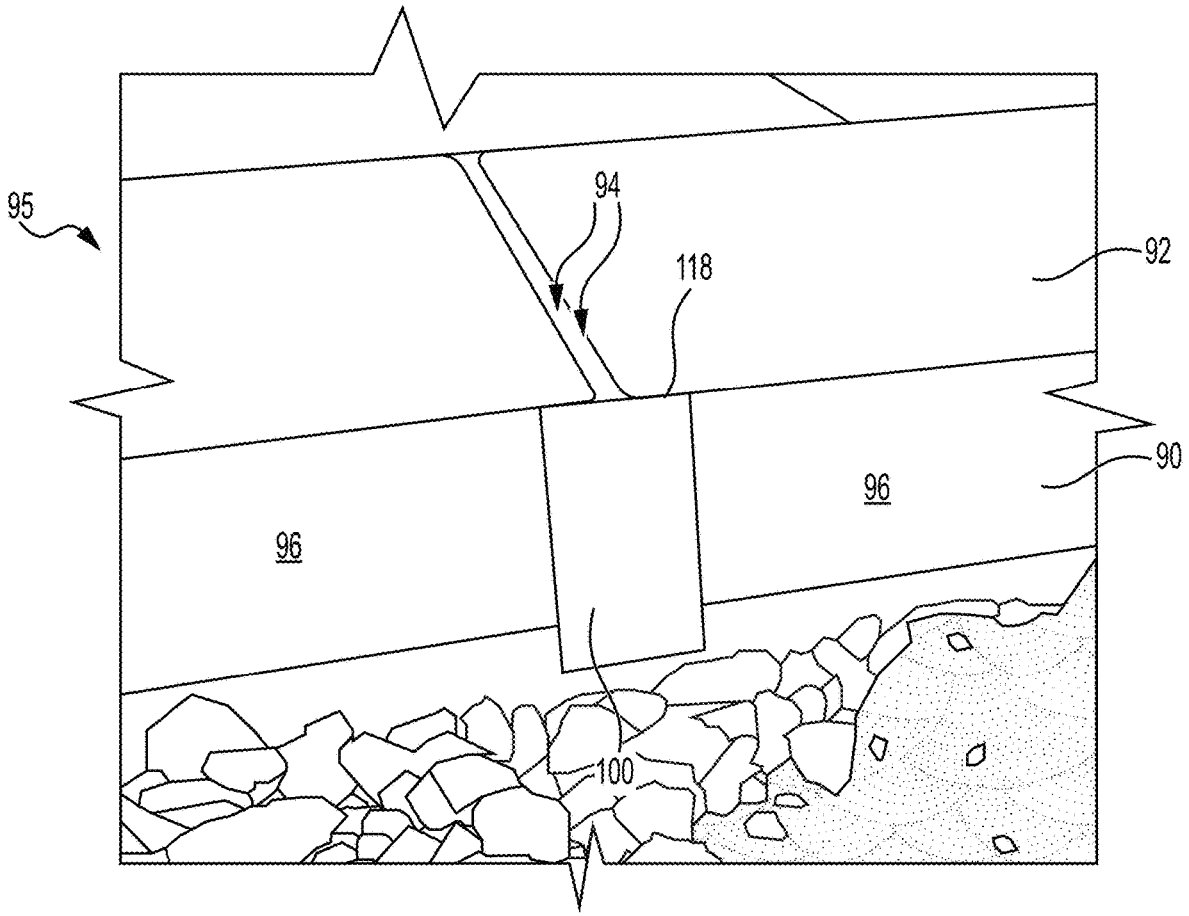
FIG. 8 is a perspective view of a portion of a stoned area where a fill blocker is installed at the edge of the stoned area.

Referring to FIG. 8, a portion of a stoned area 95 is depicted. When installing paving stones 90, preparation steps are performed such as laying down a solid level foundation to have all the paving stones 90 level and thus to obtain a level stoned area top surface. In some realizations, the foundation top surface is slightly sloped for water to flow out of the stoned area 95.

For aesthetic reasons, the paving stones 90 are installed at a constant distance to have all the gaps between the paving stones 90 of a similar width.

All the steps to get the most interesting aesthetic are frequently wasted by letting the filling material filling the gaps flow out of the gaps at the edges of the stoned area. The level of filling material in the gaps over the stoned area 95 is thus not ensure and weeds, benefitting from the missing filling material, are permitted to grow in the gaps.

In order to prevent the discussed drawbacks, the fill blocker 100 is installed by being sled at the edge of the stoned area 95 between the side faces 94 of two paving stones 90 until the holding components 130 is wedged between the mutually facing side faces 94 of the paving stones 90 and with a portion of the interior face 120, namely the, abutting the outer faces 96 of the two paving stones 90. More specifically, the paving-stone abutting portions 142 discussed above abut the outer faces 96 about the edges of the paving stones 90, thereby closing the gap between the paving stones 90 at the edges of the stoned area 95. The lips 134 extending toward the edge once wedged through their insertion in the gap retain the fill blocker 100 in the gap.

Furthermore, once the filling material fills the gap, the space between the lips 134 are also filled, thereby securing even more the position of the fill blocker 100.

Moreover, according to a realization, the fill blocker 100 has the top edge 118 of its top portion 112 level with or slightly under the top face 92 of the paving stones 90, providing the desired aesthetic.

According to realizations, the bottom portion 114 may extend downward, may be bent inwardly extending under the paving stones 90, or may be bent outwardly and being covered with side material such as soil. Finally, alternatively, the bottom portion 114 may be cut off or ripped off from the top portion 112 if desired.

According to realizations, the fill blocker 100 may be manufactured in different colors to match the color of the paving stones 90; the fill blocker 100 being less visible with a color matching the color of the paving stones 90. Similarly, the fill blocker 100 may be manufactured with textures over the exterior face 110.

According to another realization (not depicted), another fill blocker comprises a triangular or trapezoidal body having a width about the width of the gaps between the paving stones 90. The fill blocker has a long top, a height about the thickness of the paving stones 90, and a slope forcing the filling material to remain in the gap.

According to a realization, the fill blocker is designed to extend slightly outward from the stoned area 95. When the gaps are filled with filling material and afterward the filling material doused with water, the filling material hardens, allowing to remove the fill blocker afterwards with the filling material remaining in place. In such a case, the fill blocker would have a holding component that is removable from the gap.

According to a realization, the fill blocker comprises vertical hollow spaces, aka vertical channels, from the fill blocker being made of corrugated plastic, aka Coroplast™. Accordingly, when filling the gaps with filling material and/or sealer, the vertical hollow spaces are also filled thereby helping in securing the fill blocker in place.

While preferred embodiments have been described above and illustrated in the accompanying drawings, it will be evident to those skilled in the art that modifications may be made without departing from this disclosure. Such modifications are considered as possible variants comprised in the scope of the disclosure.

The invention claimed is:

1. A fill blocker to be wedged against outer faces and between side faces of paving stones which are spaced apart thereby defining a gap between side faces, the fill blocker comprising:

a body comprising an interior face configured to hold filling material; and a holding component, comprising:

a stem extending from the interior face; and a plurality of lips extending sideward in two opposed directions from the stem configured to butt up against the side faces of the paving stones whereby preventing the fill blocker from exiting the gap, wherein the lips are sloped toward the interior face relative to the stem such that the lips wedge against the side faces of the paving stones when inserted in the gap with the interior face abutting against the outer faces thereby ensuring that the fill blocker remains in place while filling the gap with the filling material.

2. The fill blocker of claim 1, wherein the interior face comprises abutting portions for abutting the paving stones outside the gap.

3. The fill blocker of claim 1, wherein the lips are sloped toward the interior face as they extend sideway from the stem.

4. The fill blocker of claim 1, wherein the interior face comprises a substantially flat portion thereby aligning the outer faces of neighboring paving stones while closing the gap therebetween.

5. The fill blocker of claim 1, wherein the body further comprises a top portion and a bottom portion and a trench area between the top portion and the bottom portion.

6. The fill blocker of claim 5, wherein the trench area is one of breakable and cuttable, thereby once the trench area is broken or cut, the bottom portion is separated from the top portion.

7. The fill blocker of claim 1, wherein the stem comprises a first stem element and a second stem element having an acute angle greater than zero (0) degree therebetween.

8. A fill blocker to block a gap between two paving stones each having an outer face and a side face, wherein the side faces of respective paving stones face each other, the fill blocker comprising:

a body comprising an interior face having two abutting portions and a fill-blocking portion therebetween configured to hold filling material; and a holding component extending from the interior face adapted to be wedged between the side faces through surfaces configured to butt up in opposed directions against the side faces of the paving stones, wherein, when the holding component is inserted in a gap between the side faces and wedged therein, the abutting portions butts up against the outer faces of the paving stones thereby preventing the fill blocker from exiting the gap.

9. The fill blocker of claim 8, wherein the holding component comprises deformable components adapted to abut the side faces of the paving stones.

10. The fill blocker of claim 9, wherein the holding component comprises a stem extending from the interior face and wherein the deformable components extend from the stem.

11. The fill blocker of claim 10, wherein the deformable components comprise a plurality of lips extending from the stem.

12. The fill blocker of claim 11, wherein the lips are sloped toward the interior face as they extend sideway from the stem.

13. The fill blocker of claim 8, wherein the abutting portions are flat.

14. The fill blocker of claim 8, wherein the body further comprises a top portion and a bottom portion and a trench area between the top portion and the bottom portion.

15. The fill blocker of claim 14, wherein the bottom portion is flexible relative to the top portion.

16. The fill blocker of claim 14, wherein the trench area is one of breakable and cuttable, thereby once the trench area is broken or cut, the bottom portion is separated from the top portion.

17. The fill blocker of claim 8, wherein the holding component comprises a pair of stems having an acute angle greater than zero (0) degree therebetween.

18. The fill blocker of claim 8, wherein the fill blocker is a unibody.

19. The fill blocker of claim 8, wherein the fill-blocking portion defines an unbroken surface.

20. A fill blocker to be wedged between side faces of paving stones which are spaced apart thereby defining a gap therebetween, the fill blocker comprising:

a body comprising an interior face configured to hold filling material; and a holding component, comprising a stem extending substantially perpendicularly from the interior face that comprises surfaces configured to butt up in opposed directions against the side faces of the paving stones;

wherein the stem wedges against the side faces of the paving stones when inserted in the gap thereby ensuring that the fill blocker remains in place while filling the gap with the filling material.

* * * * *